US005991921A

United States Patent [19]

Saito

[11] Patent Number: 5,991,921

[45] Date of Patent: Nov. 30, 1999

[54] DUSTPROOF SUIT FOR CLEAN ROOM

[75] Inventor: Toru Saito, Tokyo, Japan

[73] Assignee: Toyo Lint Free Co., Ltd., Tokyo, Japan

[21] Appl. No.: 08/969,168

[22] Filed: Nov. 12, 1997

[30] Foreign Application Priority Data

Dec. 3, 1996 [JP] Japan ..... 8-336234

[51] Int. Cl.[6] ..... A41D 13/00

[52] U.S. Cl. ..... 2/69; 2/84; 2/456; 2/901

[58] Field of Search ..... 2/69, 22, 219, 2/2.11, 901, DIG. 3, 84, 202, 2.17, 69.5, 94, 93, 206, 79, 268, 456, 457, 2.16, 458, 2.14, 114; 128/201.29, 201.28, 203.28, 205.13, 205.17, 205.29, 204.18

[56] References Cited

U.S. PATENT DOCUMENTS

| | | | |
|---|---|---|---|
| 3,713,480 | 1/1973 | Low et al. | 165/46 |
| 5,588,153 | 12/1996 | Ignon et al. | 2/457 |
| 5,652,966 | 8/1997 | Reinert | 2/457 |

FOREIGN PATENT DOCUMENTS

| | | |
|---|---|---|
| 62-33806 | 2/1987 | Japan . |
| 6-11923 | 2/1994 | Japan . |

*Primary Examiner*—Jeanette E. Chapman
*Assistant Examiner*—Tejash D Patel
*Attorney, Agent, or Firm*—Frishauf, Holtz, Goodman, Langer & Chick

[57] ABSTRACT

A dustproof suit for a clean room is provided. The dustproof suit includes a garment, a pair of inner pants disposed inside the garment, a hood detachably mounted on the garment and a suction unit attached to the garment for decompressing an interior of the garment. The suction unit consists of a suction belt arranged inside the garment and an air cleaner arranged outside the garment so as to associate with the suction belt. The suction belt is provided with a hollow passage and a plurality of suction holes communicating with the hollow passage. In operation, owing to sucking operation of the air cleaner, air in the garment is firstly sucked into the suction belt through the suction holes. Then, dust contained in the air is then filtrated by the air cleaner and sequentially discharged to an outside of the garment.

10 Claims, 4 Drawing Sheets

DUSTPROOF SUIT FOR CLEAN ROOM

BACKGROUND OF THE INVENTION

The present invention relates to a high-functional dustproof suit which is suitable for working in a clean room having high cleanliness.

Hitherto, with the increased precision for a variety of industrial products (e.g. computers, semiconductors etc.), there were many requirements for a dustproof suit used in the clean room: an improvement of cloths as filtering members; a reduction of ducts separated from the cloths; an improvement of sealing capability of hems and sleeves and so on. In order to cope with such requirements, there has been generally provided a dustproof suit which can enhance its sealing capability by adopting cloth of low-dustiness while squeezing its sleeves and hems.

In the above-mentioned dustproof suit, however, an air pressure inside the suit varies up and down with respect to an air pressure in the clean room due to various motions of a worker, so that air containing dust in the dustproof suit is discharged from fine clearance about the sleeves and the hems into the clean room. Thus, there is a limit to prevent an occurrence of dust in the above-mentioned dustproof suit.

Recently, with the remarkable developments in industrial fields using the clean room, such as a recent increase in integration density of an integrated circuit in semiconductor industry, it has been required a dustproof suit which is suitable for the clean room having a higher cleanliness. Under such a situation, it has been proposed to suck air in the dustproof suit in order to maintain the interior of dustproof suit under its decompressed condition in comparison with an air pressure of the clean room, thereby preventing air containing dust in the dustproof suit from diffusing.

Meanwhile, as one example of the above-mentioned dustproof suit, Japanese Patent Publication (kokoku) No. 6-11923 and Japanese Patent Publication (kokai) No. 62-33806 disclose a dustproof suit in which a suction hose having a number of suction ports is spread. In this dustproof suit, one end of the suction hose is connected with an air cleaner in order to such and filtrate the air in the dustproof suit, whereby cleaned air with no dust can be discharged into the clean room. In this dustproof suit, however, it is not only uncomfortable for a worker to wear it but troublesome to undress it because a structure of a suction part installed therein is complicated and relatively large. From these reasons, such a dustproof suit has never been put to practical use in the present circumstances.

SUMMARY OF THE INVENTION

It is therefore an object of the present invention to provide a dustproof suit which does not give the worker wearing it an unpleasant feeling and which is easy for the worker to undress and is suitable for using in a clean room having high cleanliness.

The object of the present invention described above can be accomplished by a dustproof suit for sucking air in the dustproof suit thereby to maintain an interior of the dustproof suit under its decompressed condition relative to a pressure of a clean room, the dustproof suit comprising:

- a garment consisting of a pair of pants and a jacket, both of which are formed in one body;
- a pair of inner pants disposed inside the garment, each of the inner pants having a elastically squeezed hem for defining a predetermined suction area in each of said inner pants;

- a hood detachably mounted on the jacket, the hood having an opening formed at a position corresponding to a worker's face and covered with a shade for opening and closing the opening; and
- a suction unit attached to the garment for decompressing an interior of the garment, the suction unit including:
  - a suction belt arranged inside the garment and tied round a worker's waist portion, the suction belt being in form of a band member having a hollow passage formed to extend along a longitudinal direction of the band member and a plurality of suction holes formed on upper and lower surfaces of the band member so as to communicate with the hollow passage; and
  - an air cleaner arranged outside the garment so as to associate with the suction belt, for sucking air into the suction belt through the suction holes, sequentially filtrating the air and finally discharging it outside the garment.

With the above-mentioned arrangement, the interior of the garment and the hood is decompressed by the suction unit in order to prevent dust from diffusing, Therefore, even if the worker wears the suction unit on a normal working wear without taking such an inner wear's dustiness into consideration, it is possible to exclude any possibility of contamination of dust for the clean room. Moreover, since the suction belt is constructed so as to be attached on the worker's waist portion, it is possible for the worker to handle it without any sense of incompatibility and with ease.

In the present invention, preferably, the suction belt has an air outlet formed at a position corresponding to a worker's back so as to communicate with the hollow passage.

More preferably, the garment is provided, at a portion corresponding to a worker's waist portion on a worker's back side, with an opening through which the air outlet of the suction belt is communicated with the air cleaner.

Preferably, the garment further includes an annular member which is engaged in the opening for facilitating to connect the air cleaner with the suction belt through the garment.

Furthermore, it is preferable that the annular member is made of either metal or synthetic resin.

Alternatively, the garment may have a slit formed so as to extend from a side part of the portion corresponding to the worker's waist portion to a back part corresponding to the worker's back and terminate at the opening, the slit being capable of closing by means of a fastener.

In this case, it is more preferable that the garment further includes an annular member which is engaged in the opening for facilitating to connect the air cleaner with the suction belt through the garment.

Also in this case, preferably, the annular member is made of either metal or synthetic resin.

These and other objects and features of the present invention will become more fully apparent from the following description and appended claims taken in conjunction with the accompany drawing.

DESCRIPTION OF THE PREFERRED EMBODIMENT

Figure 1:
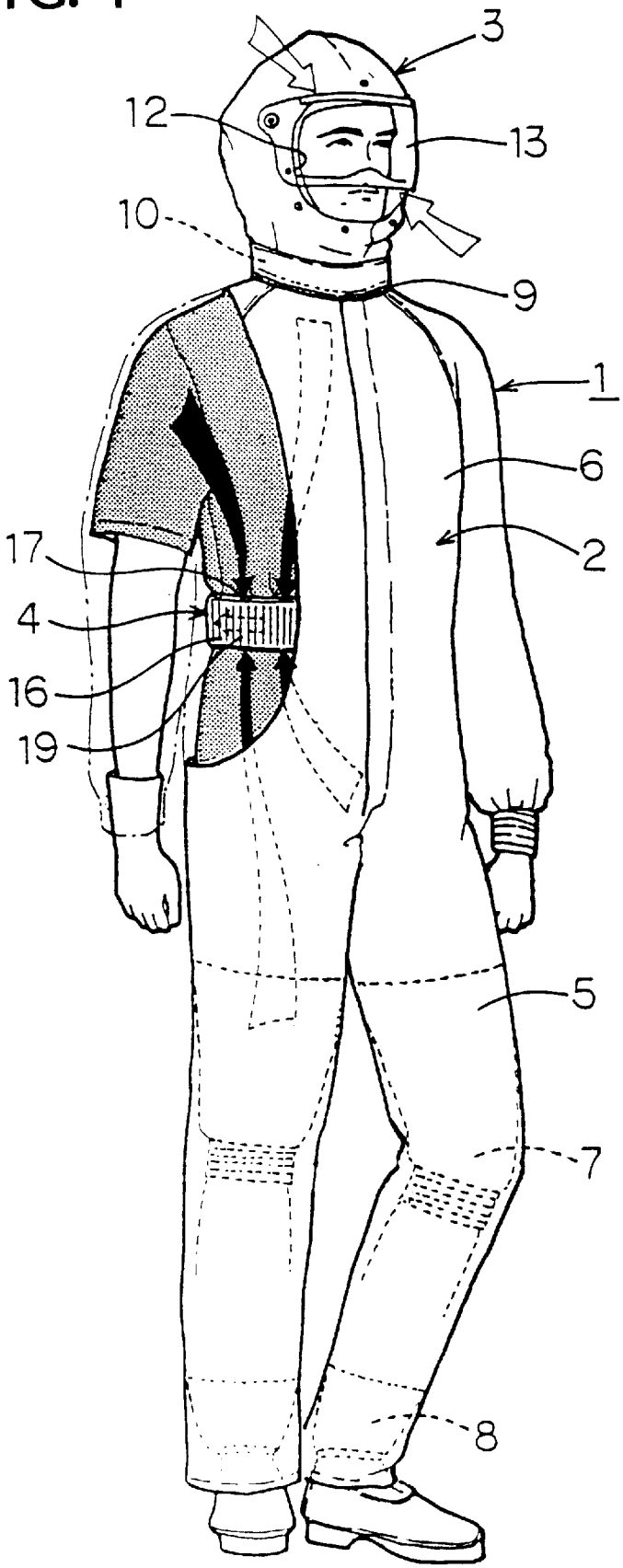
FIG. 1 is an explanatory partially-broken view showing a dustproof suit in accordance with an embodiment of the present invention.
Figure 2:
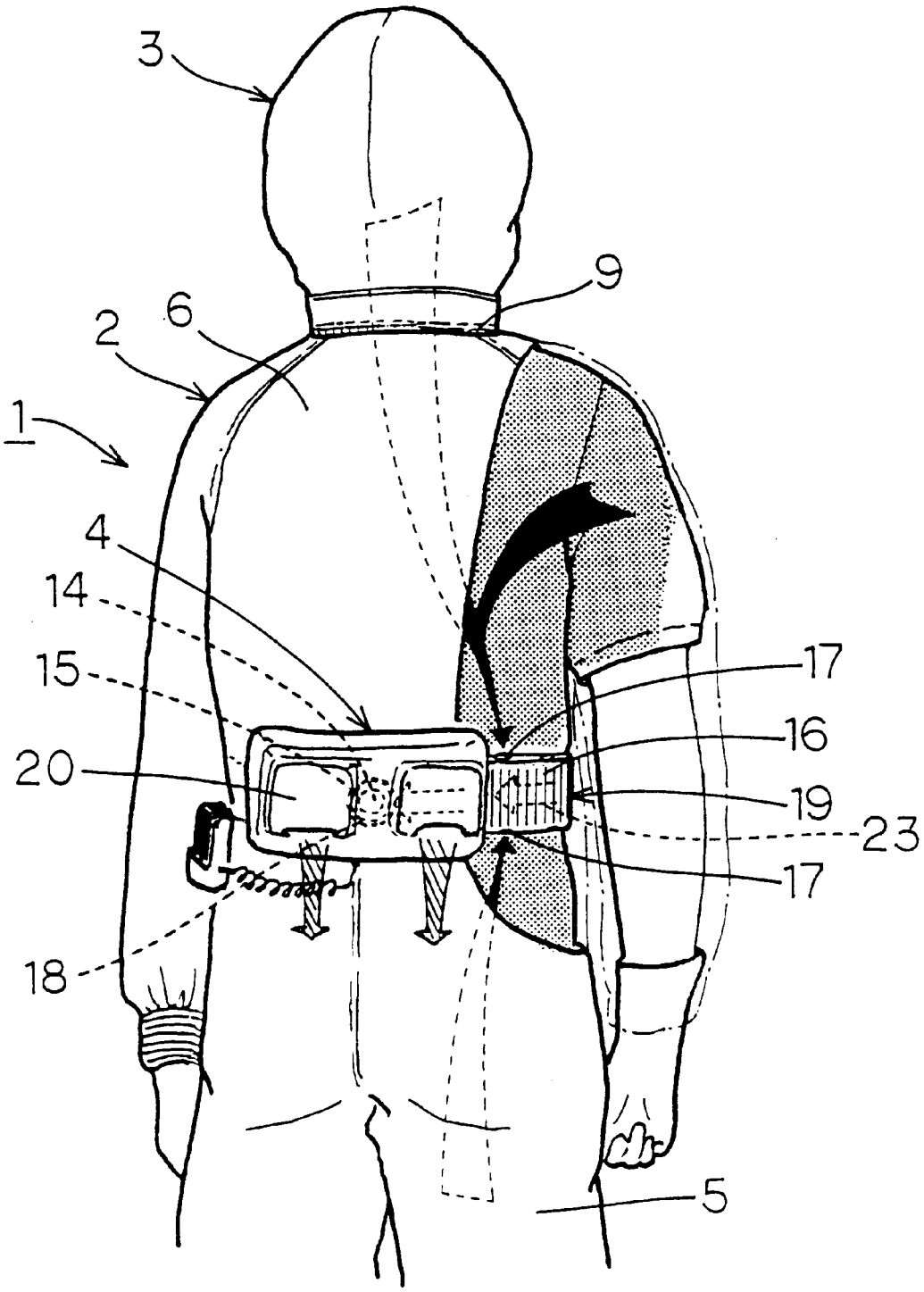
FIG. 2 is an explanatory back view of the dustproof suit of FIG. 1.

An embodiment of the present invention will be described with reference to the drawings. As shown in FIGS. 1 and 2, a dustproof suit 1 of the invention comprises a garment 2, a hood 3 and a suction unit 4. The garment 2 is made of so-called "low-dustiness" cloths which do not separate particles of fiber therefrom. The garment 2 is composed of pants 5 and a jacket 6 which are formed in one body. Provided inside the pants 5 are inner pants 7 which has an appropriate length for defining a zone to be decompressed by sucking and respective bottoms throttled elastically. Further, inside the bottoms of the pants 5, blocking parts 8 are arranged to fit an operator's ankles elastically and close the interior of the pants 5.

Figure 3:
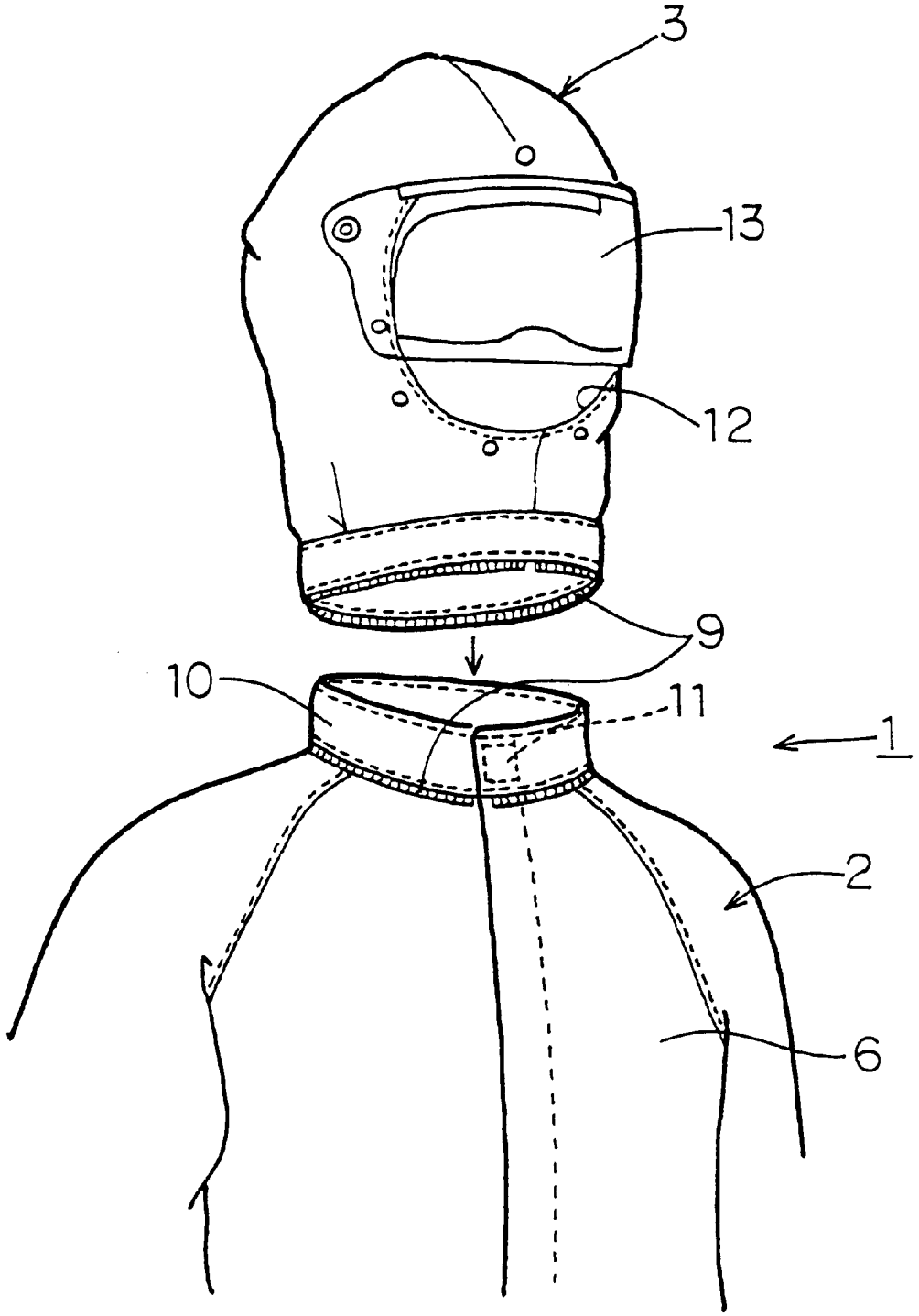
FIG. 3 is an explanatory view showing a relationship between a hood and a garment of the dustproof suit of FIG. 1.

In order to detachably attach the hood 3 to the garment 2, a fastener 9 is attached about a neck part of the garment 2, as shown in FIG. 3. Arranged inside the fastener 9 is a stand-up collar 10 of a predetermined width, which has overlapping collar ends connected by a surface fastener 11, for enhancing the sealing capability about the neck part. The hood 3 is also made of the low dusty cloths and is provided, on its opening 12 formed corresponding to the operator's face, with a transparent shade 12 of synthetic resin, which can open and close.

While, on the back side of the garment 2, an opening 14 is formed on a waist part of the garment 2, for attachment with the suction unit 4. In order to prevent fabric threads about the opening 14 from being loosen and facilitate attaching of the suction unit 4, an annular member 15 made of metal or synthetic resin is fitted into the opening 14. The suction unit 4 comprises a suction belt 19 and an air cleaner 20. The suction belt 19 is shaped to be one band member 16 having a flat cross section. The suction belt 19 has a hollow passage 23 formed to extend along a longitudinal direction of the band member 16, a plurality of air suction ports 17 formed on upper and lower sides of the member 16 and an air passage port (outlet) 18 formed at position corresponding to a back portion of a worker wearing the belt 19. On the other hand, the air cleaner 20 operates to filtrate dust contained in the sucked air and sequentially discharge the resulting cleaned air to the outside of the garment 2. The suction belt 19 is attached to the waist portion of the worker on the inner side of the garment 2 so as to exposed the air passage port 18 exposes to the outside through the opening 14 of the garment 2, whereby the air cleaner 20 can be connected to the port 18 from the outside of the garment 2.

The dustproof suit 1 constructed above is worn by the worker, as follows.

First of all, the suction belt 19 is attached to the waist portion of the worker. Thereafter, the garment 2 is worn by the worker, while the air cleaner 20 is connected to the air passage port 18 from the outside of the garment 2. At last, the hood 3 is put on the worker's head, so that the wearing is completed.

The dustproof suit 1 constructed above operates as follows.

By starting to drive the suction fan installed in the air cleaner 20, the air in the garment 2 is sucked into the suction belt 19 through the air suction ports 17 and introduced into the air cleaner 20 through the air passage port 18. At the air cleaner 20, fine dusts etc. in the air are filtrated and thereafter, the resultant cleaned air is discharged into the clean room.

Then, with the sucking of the air in the garment 2 through the air suction ports 17, the interior of the garment 2 is decompressed, so that there are produced various air flows which flow from the clean room into the garment 2 through a clearance about the shade 13 provided on the opening 12 of the hood 3, cuffs, fasteners or the like. Accordingly, owing to the occurrence of the air flows, it is possible to prevent the air containing the dusts from being diffused through the above-mentioned clearances.

Further, according to the embodiment, since the area to be decompressed can be limited by the inner pants 7 arranged inside the pants (portion) 5 of the garment 2, it is possible to increase suction efficiency of the suction unit 4. Further, owing to the provision of the closing parts 8 for closing the inside hems of the outer pants 5, it is possible to prevent dusts inside the pants 7 from falling down.

While, since the hood 3 is constructed by the transparent synthetic shade 13 which is attached on the opening 12 so as to open and close, for example, a microscopic operation can be easily executed by the worker's opening of the shade 13.

Further, it should be noted that, since the hood 3 with the shade 13 is heavy in comparison with the garment 2, the hood 3 is constructed so as to be detachable from the garment 2 by means of the fastener 9. This arrangement allows the worker to put on the hood 3 after wearing the garment 2, thereby facilitating a wearing of the dustproof suit 1 of the invention.

Figure 4:
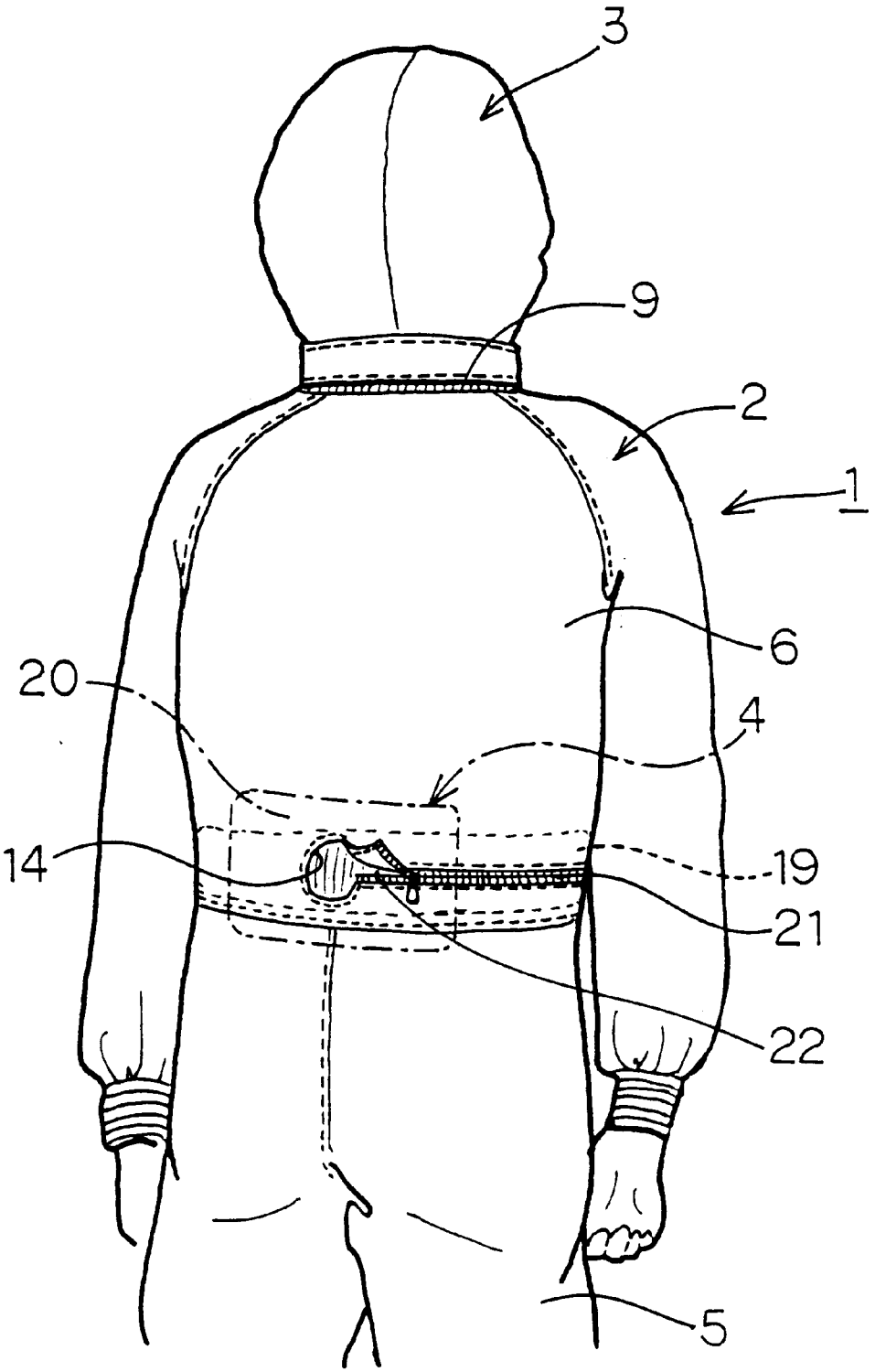
FIG. 4 is an explanatory diagram showing a dustproof suit in accordance with another embodiment of the present invention.

In the modification, as shown in FIG. 4, a slit 22 may be formed in the garment 2 so as to extend from a side part of the waist portion to the back part and finally terminate at the opening 14. Note, in this case, the slit 22 is adapted so as to close by means of a fastener 21 or the like. With the arrangement mentioned above, if the air passage port 18 of the suction belt 19 is connected with the air cleaner 20 at the side part of the waist portion and thereafter, the air cleaner 20 is moved to the back part by rotating the suction belt 19 around the worker's body and the fastener 21 is closed up, it is possible for the worker to accomplish the connection of the suction belt 19 with the air cleaner 20 easily.

In this way, according to the invention, since the interior of the garment and the hood is decompressed by the suction unit thereby to prevent the diffusion of dust, there is no possibility of contamination of dust for the clean room even if the suction unit is put on a normal working wear without taking such an inner wear's dustiness into consideration. Moreover, since the suction belt is constructed so as to be attached on the worker's waist portion, it is possible for the worker to handle it without any sense of incompatibility and with ease.

In operation, since the air is mostly introduced into the decompressed garment through the clearance about the shade, the worker is not subjected to "closed" or "restricted" feeling and is able to breathe easily. Thus, in case of a long-sustained operation, the worker can do it with little fatigue. In addition, since the arrangement of the invention allows the worker to look into a microscope while opening the shade, it is possible to improve the working efficiency advantageously.

Finally, it will be understood by those skilled in the art that the foregoing description is one of preferred embodiments of the disclosed dustproof suit, and that various changes and modifications may be made to the present invention without departing from the spirit and scope thereof.

What is claimed is:

1. A dustproof suit for sucking air in the dustproof suit thereby to maintain an interior of the dustproof suit under its decompressed condition relative to a pressure of a clean room, said dustproof suit comprising:

a garment consisting of a pair of pants and a jacket, both of which are formed in one body;

a pair of inner pants disposed inside said garment, each of said inner pants having a elastically squeezed hem defining a predetermined suction area in each of said inner pants;

a hood detachably mounted on said jacket, said hood having an opening formed at a position corresponding to a worker's face and covered with a shade for opening and closing said opening; and a suction unit attached to said garment for decompressing an interior of said garment, said suction unit including:

a suction belt arranged inside said garment and tied around a worker's waist portion, said suction belt being in the form of a band member having a hollow passage formed to extend along a longitudinal direction of said band member and a plurality of suction holes formed on upper and lower surfaces of said band member so as to communicate with said hollow passage; and an air cleaner arranged outside said garment and connected with said suction belt, said air cleaner sucking air into said suction belt through said suction holes, sequentially filtrating the air and finally discharging it outside said garment.

2. A dustproof suit as claimed in claim 1, wherein said suction belt has an air outlet formed at a position corresponding to a worker's back so as to communicate with said hollow passage.

3. A dustproof suit as claimed in claim 2, wherein said garment is provided, at a portion corresponding to a worker's waist portion on a worker's back side, with an opening through which said air outlet of said suction belt is communicated with said air cleaner.

4. A dustproof suit as claimed in claim 3, wherein said garment further includes an annular member which is engaged in said opening for facilitating to connect said air cleaner with said suction belt through said garment.

5. A dustproof suit as claimed in claim 4, wherein said annular member is made of metal.

6. A dustproof suit as claimed in claim 4, wherein said annular member is made of synthetic resin.

7. A dustproof suit as claimed in claim 3, wherein said garment has a slit formed so as to extend from a side part of said portion corresponding to said worker's waist portion to a back part corresponding to said worker's back and terminate at said opening, said slit being capable of closing by means of a fastener.

8. A dustproof suit as claimed in claim 7, wherein said garment further includes an annular member which is engaged in said opening for facilitating to connect said air cleaner with said suction belt through said garment.

9. A dustproof suit as claimed in claim 8, wherein said annular member is made of metal.

10. A dustproof suit as claimed in claim 8, wherein said annular member is made of synthetic resin.

* * * * *